US006341662B1

(12) United States Patent
Karlsson

(10) Patent No.: US 6,341,662 B1
(45) Date of Patent: Jan. 29, 2002

(54) MUFFLER WITH CATALYTIC CONVERTER

(75) Inventor: Egon Karlsson, Storebro (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/509,279

(22) PCT Filed: Oct. 1, 1998

(86) PCT No.: PCT/SE98/01771

§ 371 Date: Apr. 13, 2000

§ 102(e) Date: Apr. 13, 2000

(87) PCT Pub. No.: WO99/17007

PCT Pub. Date: Apr. 8, 1999

(30) Foreign Application Priority Data

Oct. 1, 1997 (SE) ..... 9703582

(51) Int. Cl.[7] ..... B21J 1/00
(52) U.S. Cl. ..... 181/230; 181/240; 181/258
(58) Field of Search ..... 181/230, 240, 181/258; 60/299, 302

(56) References Cited

U.S. PATENT DOCUMENTS 4,867,270 A 9/1989 Wissmann et al.
5,229,080 A * 7/1993 Abe et al. ..... 422/174
5,651,249 A 7/1997 Nagao et al.
5,736,690 A * 4/1998 Karlsson ..... 181/230
5,866,859 A * 2/1999 Karlsson et al. ..... 181/230
5,983,631 A * 11/1999 Mineo ..... 60/299
6,047,544 A * 4/2000 Yamamoto et al. ..... 60/285
6,109,026 A * 8/2000 Karlsson et al. ..... 60/302

FOREIGN PATENT DOCUMENTS

EP 785 342 A1 7/1997

* cited by examiner

*Primary Examiner*—Robert E. Nappi
*Assistant Examiner*—Kim Lockett
(74) *Attorney, Agent, or Firm*—Pearne & Gordon LLP

(57) ABSTRACT

A muffler with catalytic converter (1) in which at least one catalytic converter element (2) is located in the muffler so that an essential part of all exhaust gases (3) from the engine are forced to pass through the element (2) and be converted there into cleaned exhaust gases (4). The element is designed as an essentially self-supporting body of catalytic material, which is hollow or partly concave and has inner and outer surfaces (6, 7), e.g. the body is shaped as a circular or non-circular sleeve, or possibly even as a narrowing sleeve (8), a dome-shaped or angular bowl-shaped body (5), and the element is, either directly or via intermediary elements, mounted to a dividing part inside the muffler, such as a partition wall (10), an outlet duct (11) or an inlet duct (12), and the mounting is so arranged that at least one end surface (13, 14) is kept fixed at the same time as the element is supported at the outer surface (7) by at least one part (10, 18, 23, 24), while the inner surface is essentially free.

9 Claims, 5 Drawing Sheets

MUFFLER WITH CATALYTIC CONVERTER

TECHNICAL FIELD

The subject invention refers to a muffler with catalytic converter, in which at least one catalytic converter element is located in the muffler, so that an essential part of all exhaust gases from the engine are forced to pass through the element and there be converted into cleaned exhaust gases.

BACKGROUND OF THE INVENTION

Catalytic mufflers for internal combustion engines are well-known since a very long time, and have mainly been intended for cars. For portable working tools, such as chain saws, they have been available on the market to a small extent since the end of the 1980's. Demands for low weight, size and cost have contributed towards the fact that catalytic converter technology was put into practice considerably later within this field. The catalytic mufflers which have been used for portable working tools, generally included a catalytic converter element built-up of coated thin sheet metal strips, e.g. a pleated or corrugated metal strip could be rolled together with a plane strip into a cylindrical element. Both strips are coated with a catalytic layer and the exhaust gases are conducted through the axial cavities which are created between the strips and in this manner the exhaust gases are converted. This type of catalytic converter element is comparatively expensive at the same time as it is sensible to vibrations and it therefore requires an elaborately designed mounting in order to obtain an acceptable lifetime, seen from a pure mechanical point of view.

Catalytic converter elements composed of a thread-formed material are known for a long time. These catalytic converter elements are generally designed like plates or cylindrical elements of different lengths. They are usually made of a stainless steel wire material which has been crochetted into a plane sheet, which then has been folded a couple of times, or, rolled together into a homogeneous cylinder. DE 3024491 also describes some examples of elements where a sheet has been rolled up to be a tubular element. This tubular element is mounted along an inner diameter. The mufflers described were mainly intended for use in cars. As far as the applicant knows no muffler with a thread-formed catalytic converter element has reached the market before. Since these catalytic converter elements generally can be manufactured at a low cost compared with other types of catalytic converter elements, probably the lifetime of these elements has been considered as unsatisfactory from a mechanical point of view. For, the heat generation in a catalytic converter element is high, especially in elements intended for two-stroke engines. In such an element temperatures of overbearingly 1000 degrees centigrade can occur. In the tests made by the applicant of such a muffler the mounting as well as the design of the catalytic converter element have turned out to be utmost important in order to achieve an adequate lifetime.

DE 19514828 and DE 19643191 are showing examples of catalytic mufflers where a catalytic material with an extremely limited stability has been used. The catalytic material is a fibre material which is enclosed between close-meshed nets on both sides. Consequently, the catalytic material is not composed of a self-supporting body but is completely dependent on support from essentially all sides. In order to achieve enough durability the close-meshed nets must therefore lie close to each other meaning that the catalytic converter element is small in thickness. Naturally this means that the duration of the flow passing through the element is short. It will therefore be difficult to achieve a high conversion ratio in the catalytic converter at the same time as the total design of the conversion unit will be relatively complicated and expensive.

Purpose of the Invention

The purpose of the subject invention is to substantially reduce the above outlined problems.

SUMMARY OF THE INVENTION

The above mentioned purpose is achieved in that the catalytic muffler in accordance with the invention having the characteristics appearing from the appended claims.

The catalytic muffler according to the invention is thus essentially characterized in that the element is designed as an essentially self-supporting body made of catalytic material, which is hollow, or partly concave, and has inner and outer surfaces, e.g. the body is shaped as a circular or non-circular or possibly even as a narrowing sleeve, a dome-shaped or angular bowl-shaped body, and the element is, directly or via intermediary elements, mounted to a deviding part inside the muffler, such as a partition wall or an outlet or inlet pipe, and the mounting is arranged so that at least one end surface is kept fixed at the same time as the element is supported at the outer surface by at least one part while the inner surface is essentially free. The element is thus designed as an essentially self-supporting body made of catalytic material. It means that the element does not have to be encased on all sides but certain surfaces can be left free. Since the element is essentially self-supporting the surfaces which have to be provided with inlet or outlet openings can be made with considerably fewer and larger holes. This results in a more simple and efficient design at the same time as it enables saving of costs.

The shape as well as the mounting of the catalytic element are of great importance for its lifetime. A hollow or partly concave shape is especially advantageous. It could be a sleeve or a bowl-shaped body, and these are normally circular or dome-shaped, but could also have a polygonal angular form. All these shapes described have in common that the element can have a great form stability and that the wires in the element can run around the element, e.g. a sleeve-shaped element can be created from a crochetted tube-shaped sleeve in that the ends of the sleeve are being folded into themselves and the sleeve is being pressed in an axial direction between an inner and an outer tool. In this manner a cylindrical or conical or possibly an angular sleeve can be created. The element consists of a number of closed threads extending around the element and this in turn of course creates a very great stability, which is advantageous considering the very high temperatures the element is being exposed to.

The mounting of the catalytic converter element into the muffler is extremely important since it affects the stability as well as the cooling of the element. As for an element formed as a sleeve it has turned out to be especially advantageous to hold both ends fixed and support the element at its outer surface. Preferably the ends are kept fixed in that they are inserted into adapted depressions in the surrounding parts. This creates a stable mounting of the ends, which will stable the whole element. This is particularly true if the element has a relatively limited length. To support the element at the outer surface is advantageous. Since the element becomes warmer than its own housing it tends to expand against the outer surface and in this manner it will get an improved support. The outer surface is larger than the inner surface and hereby the cooling of the outer surface can be more effective. Furthermore, as a rule the untreated exhaust gases from the engine have better access to the outer surface and its enclosure than to the inner surface. This contributes highly to a better cooling of the outer surface. From many points of view it is thus advantageous to support the outer surface and left the inner surface essentially free. This reasoning is also valid for a bowl-shaped body. Such a body has only one end surface. Preferably this end surface is kept fixed while the outer surface is supported and the inner surface is essentially left free. These and other characteristic features and advantages will become more apparent from the detailed description of various embodiments with the support of the annexted drawing.

BRIEF DESCRIPTION OF THE DRAWINGS

The invention will be described in closer detail in the following by way of various embodiments thereof with reference to the accompanying drawing figures.

DESCRIPTION OF THE PREFERRED EMBODIMENTS

Figure 1:
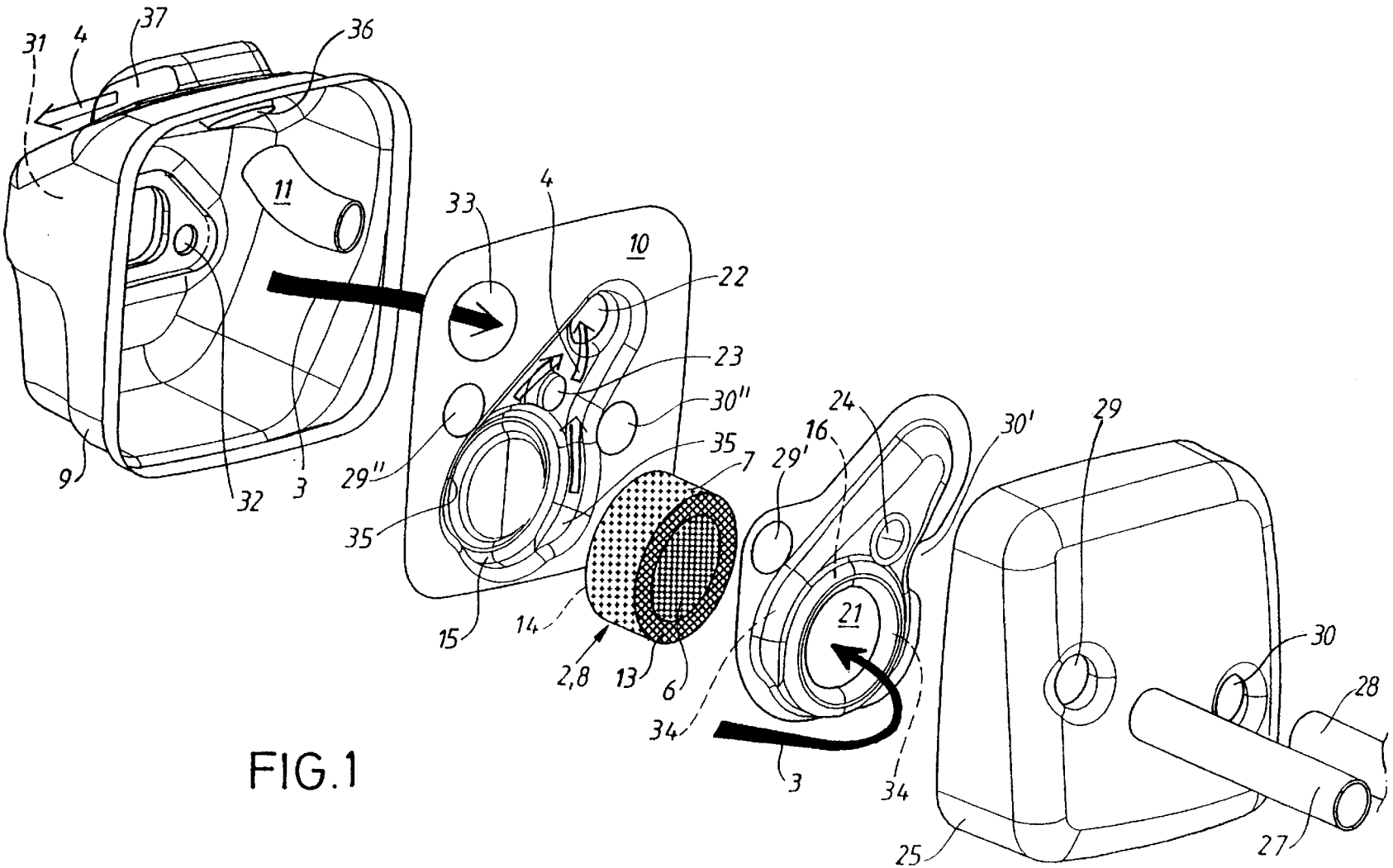
FIG. 1 shows in perspective a catalytic muffler according to the invention. Its parts are shown in an exploded view-manner to make the construction and functioning of the muffler more clear.

In the schematical FIG. 1 numeral reference 1 designates a catalytic muffler. It has two mutually demountable housing parts, i.e. a rear housing part 9 and a front housing part 25. A partition wall 10 is clamped between the both housing parts. A catalytic converter element 2 is clamped between the partition wall 10 and a cover plate 18, which is mounted to the partition wall, e.g. by means of spot welding. The catalytic converter element is in this case a sleeve 8 having a cylindrical form. But it could also have a conical form. It has an inner surface 6 and an outer surface 7 as well as end surfaces 13, 14. The element is kept fixed in that the rear end surface 14 is resting in an adapted depression 15 in the partition wall 10 at the same time as the front end surface 13 is resting in an adapted depression 16 in the cover plate 18. Thus, in this case the sleeve 8 is round, but it could also be non-circular and have three or several side-surfaces. The adapted depressions 15 and 16 will of course get the equivalent form.

The muffler is fastened with screws directly to the exhaust port of the cylinder, said screws are not shown here. These screws extend through apertures 31 and 32 in the rear housing part 9. The former aperture is concealed. An exhaust port 26 in the rear housing part connects towards the very exhaust port of the cylinder. Distance pipes 27 and 28 are lead through the front housing, the cover plate and the partition wall in order to support against the rear housing part 9 around the apertures 31 and 32. The distance pipe 27 is lead through an aperture 29 in the front housing, an aperture 29' in the cover plate and an aperture 29" in the partition wall. The distance pipe 28 is lead through an aperture 30 in the front housing, a recess 30' in the cover plate and an aperture 30" in the partition wall. Screws, which are not shown here, are then inserted through the distance pipes and tightened to the cylinder. This is a conventional arrangement and will therefore not be commented on in any further detail.

Exhaust gases 3 from the exhaust port are flowing out through at least one aperture 33 in the partition wall 10. The exhaust gases will then turn their direction and flow in through at least one inlet opening 21 arranged inside the adapted depression 16 in the cover plate 18. Thereafter the gases are flowing radially outwards through the element 2. The cover plate 18 is provided with a duct 34, which connects to the outer surface 7 of the sleeve 8. The duct 34 is formed through an immersed part in the cover plate. The immersed part is not as deep as the adapted depression 16. Thereby the front end surface 13 is kept fixed around its whole circumference. The partition wall 10 is provided with a corresponding duct 35. The cleaned exhaust gases 4 flow through the both ducts 34 and 35 away from the sleeve 8. The sleeve 8 is thus kept fixed at both of its end surfaces 13, 14 while a great part of its outer surface 7 is free, so that the exhuast gases can flow out through the element.

Figure 2:
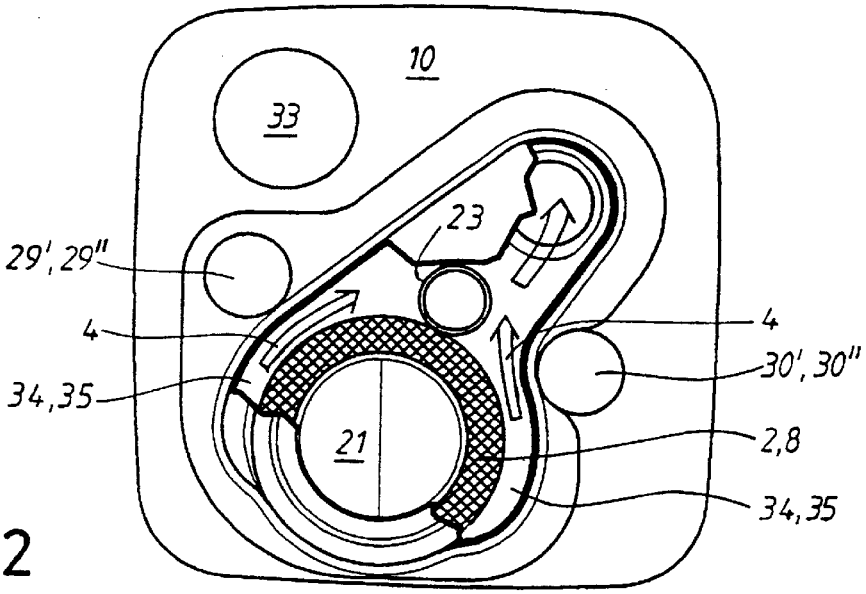
FIG. 2 shows straight from the front a partition wall with a catalytic converter element and cover plate according to FIG. 1.

By comparing FIG. 1 and FIG. 2, which is a cross-section through the cover plate 18 and the sleeve, you can see that the ducts 34, 35 are not reaching all the way around the whole sleeve 8, but approximately 90 degrees of angular section is saved, as shown in the lower part of the figure. It means that the sleeve 8 is supported at its outer surface 7 along its entire length within this section of approximately 90 degrees. The sleeve is thus having a particularly good support in this section. It also means that the catalytic converter element is in principle shut off in this section. A wart 23 is arranged in the duct 35 in the partition wall. The wart 23 is thus arising from the duct 35 adjacent the adapted depression 15. It supports the outer surface 7. A corresponding wart 24 is arranged in the cover plate 18. It is placed in a position corresponding to the wart 23, and the both warts are almost reaching each other. It means that the sleeve 8 is supported along its entire length, on the one hand at the previously mentioned section downwards in the FIGS. 1 and 2, and on the other hand at the warts 23 and 24. As for the rest the both end surfaces are kept fixed in that they are immersed into the adapted depressions 15, 16. The cleaned exhaust gases 4 are flowing out into the ducts 34, 35. An outlet opening 22 connects to the duct 35. This outlet opening is embodied as a collared hole in which an outlet pipe 11 is connected. The cleaned exhaust gases 4 are thus flowing out through the outlet opening 22 and through the outlet pipe 11. The other end of the outlet pipe 11 is connected to an aperture 36 which is arranged on the upper side of the rear housing 9. The cleaned exhaust gases are conducted through an exhaust gas outlet 37 which is arranged on the upper side of the rear housing.

Obviously the partition wall and the cover plate could change place. It means that the inlet opening 21 could instead be arranged in the partition wall and the outlet opening 22 could instead be arranged in the cover plate. Both openings could also be arranged in one of the parts. Naturally the ducts 34 and 35 could also be placed only in one part and not in the other. In the described embodiment the outlet opening 22 is arranged outside the adapted depression in the partition wall, or in the cover plate. The fastening of the sleeve's both end surfaces 13, 14 is substantially contributing to the stability of the sleeve. It is therefore advantageous if its axial length is less than its outer diameter, preferably the length of the sleeve is less than half of the outer diameter. In the shown embodiment the inner- and outer surfaces 6, 7 are curving in at least one direction and the body is formed like a cylindrical sleeve 8. But it could also be formed like a conical sleeve. The adapted depressions are arranged partly in the partition wall and partly in the cover plate, which fastens the element between the partition wall and itself.

Figure 3:
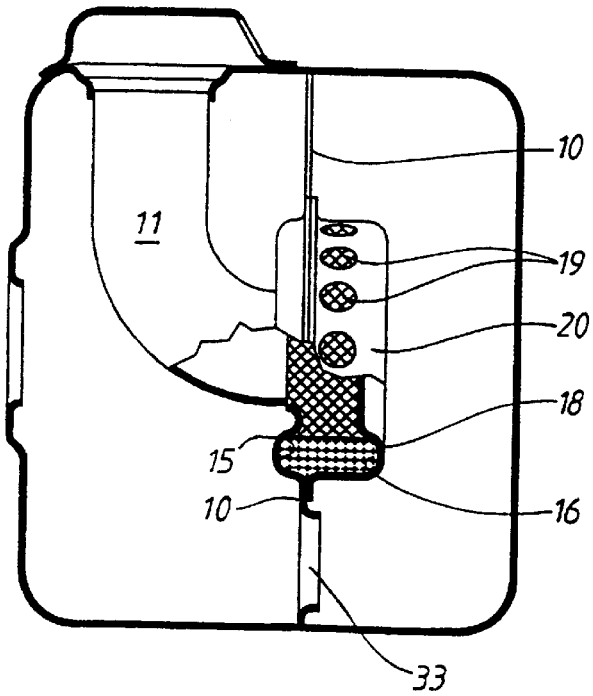
FIG. 3 shows in a cross-sectional view and seen from the side another embodiment of the catalytic muffler according to the invention. Also this embodiment is provided with a partition wall.

FIG. 3 shows a catalytic converter element in the shape of a cylindrical sleeve, which is clamped between a partition wall 10 and a cover plate 18. However, the partition wall 10 inside the adapted depression 15 is connected to an outlet pipe 11. Apertures 19 are arranged on the outside 20 of the cover plate 18, which supports the outer surface 7 of the element. In this manner exhaust gases 3 will flow radially inwards through the apertures 19 and through the element 2 in order to then flow out through the outlet pipe 11, in the same way as earlier described In this case the outside 20 of the cover plate is supporting the outer surface of the element, except for the apertures 19. Consequently, the element is here supported along most part of its outer surface 7. The figure is partly cross-sectional and it thus becomes apparent how very well the end surfaces 13 and 14 are being kept fixed into the adapted depressions 15, 16.

Figure 4:
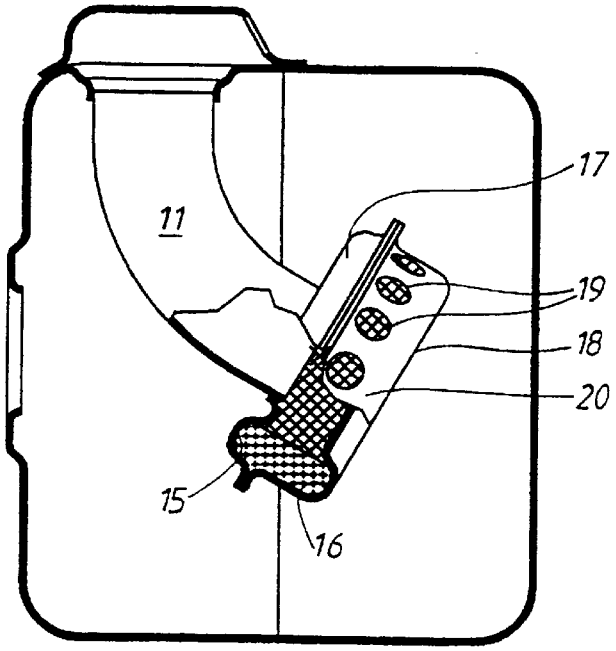
FIG. 4 shows a catalytic muffler, which is similar to that in FIG. 3, but without a partition wall.

FIG. 4 shows an embodiment which is similar to that in the FIG. 3. The partition wall 10 is here missing, which implies a certain simplification, but at the same time it could result in a reduced silencing effect. The adapted depression 15 is here arranged in a mounting part 17, which fastens the element onto the outlet pipe 11, in the same way as the partition wall 10 was connected to the outlet pipe 11, according to FIG. 3.

Figure 6:
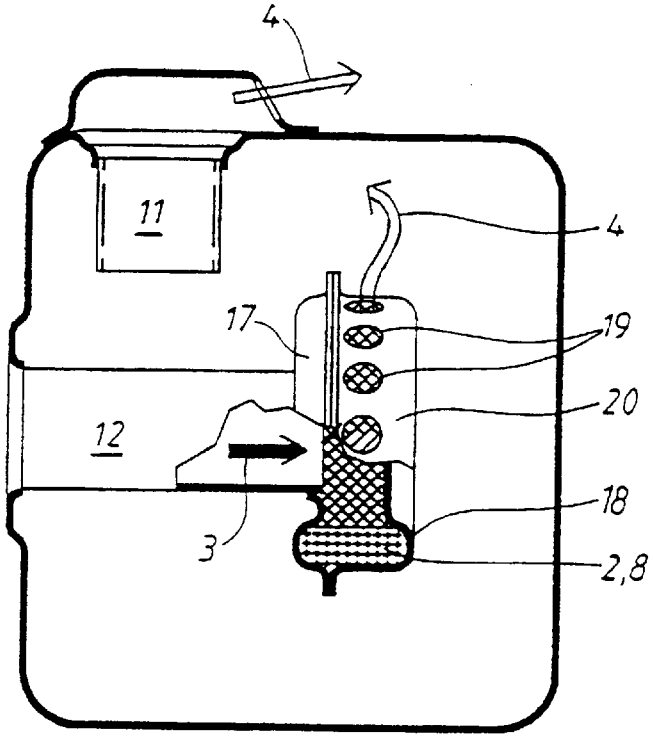
FIG. 6 shows a catalytic muffler in which the catalytic converter element is connected to an inlet pipe in the muffler. Exhaust gases will flow radially outwards through the sleeve-shaped element.

FIG. 6 shows an embodiment which is quite similar to that in the FIG. 4 in many respects. In this embodiment the mounting part 17 connects to an inlet pipe 12. In this manner exhaust gases 3 will flow radially outwards through the element 2 and out through the apertures 19. The mounting part 17 could be replaced by a partition wall 10.

Figure 7:
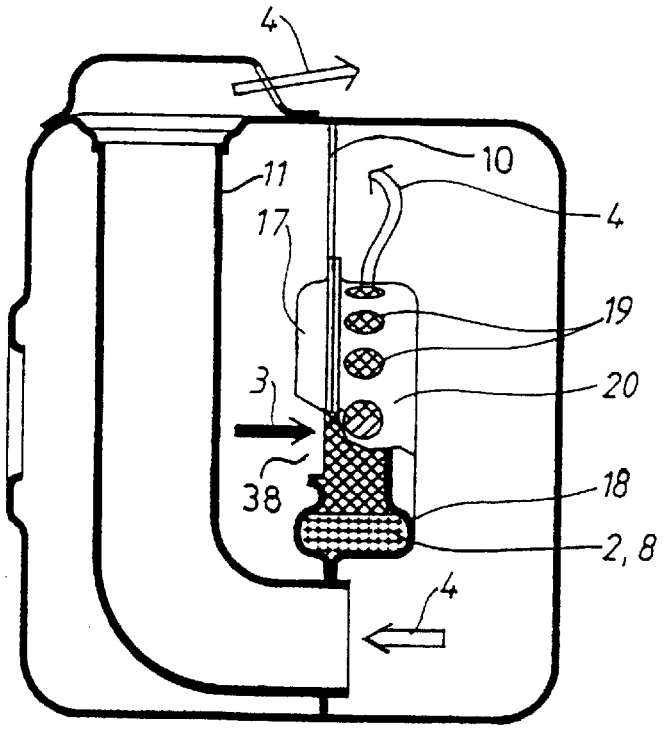
FIG. 7 shows a catalytic muffler, in which the exhaust gases are flowing radially outwards through the sleeve-shaped element. This embodiment has a partition wall with an associated outlet pipe.

FIG. 7 shows an embodiment which is quite similar to both that shown in FIG. 3 and to that in FIG. 6. As in the latter embodiment the exhaust gases 3 are flowing radially outwards through the element 2 and out through the apertures 19. As in the embodiment according to FIG. 3 the catalytic converter element is mounted onto a partition wall 10. The only difference is that the outlet pipe 11 connects to an aperture 33 located beside the catalytic converter element with its housing. Compare FIG. 3. Instead the untreated exhaust gases are now flowing into the aperture 38, which is embodied in the partition wall 10, and connects to the middle of the catalytic converter element. A flow directed outwards could be advantageous since the cylindrical sleeve 8 has a better support outwards than inwards. In the shown embodiment the outlet pipe 11 is being reflushed by the untreated exhaust gases 3. These have a lower temperature than the cleaned exhaust gases 4. In this manner the exhaust gases 3 will cool down the outlet pipe 11, which is advantageous. But obviously the outlet pipe 11 could also be connected to the partition wall in other positions outside the catalytic converter element. This could lead to a reduced cooling effect as well as a shorter outlet pipe. In the shown embodiment the cooling effect is especially substantial since the outlet pipe 11 is here located directly downstreams the exhaust gases which are flowing out from the exhaust port.

Figure 8:
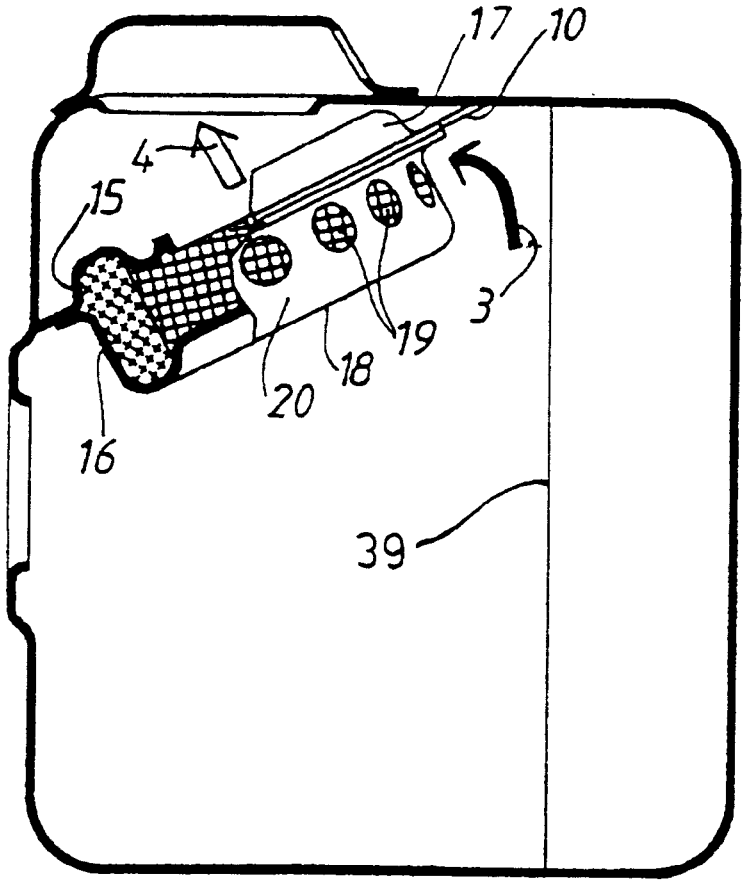
FIG. 8 shows a catalytic muffler, in which a partition wall with catalytic element separates a corner of the muffler provided with an exhaust gas outlet.

FIG. 8 shows a particularly simple solution where the outlet pipe 11, or the inlet pipe 12, is missing. This is achieved by placing the partition wall 10 with the catalytic converter element, so that it separates a corner of the muffler provided with an exhaust gas outlet. The partition wall is placed completely into one part of the muffler, i.e. in the figure to the left of the vertical line 39, which illustrates the partition between the both housing parts. Obviously this location is very advantageous considering the mounting of the partition wall 10. The both housing parts could be either detachably or undetachably mounted to each other in a conventional way. In the shown embodiment the partition wall 10 extends between the both opposite sides of the housing. Hereby a more simple and distinct figure is achieved. However, in a real case it is often preferable to let the partition wall 10 extend from a side-wall of the muffler and connect to the upper side of the muffler so that it separates only one back corner of the muffler and not as in the shown case separates two back corners of the muffler. The separated part of the muffler will become very hot owing to the very high temperature of the cleaned exhaust gases 4. It is therefore preferable to separate only one back corner of the muffler and to choose a corner having a particularly good external cooling. In the shown embodiment the untreated exhaust gases 3 are flowing radially inwards through the catalytic converter element. But obviously the catalytic coverter element could be turned right about, so that the untreated exhaust gases 3 instead are flowing in at the middle of the catalytic converter element and then flow radially outwards through the apertures 19. Consequently, in this case the apertures are instead located within the separated part of the muffler, which connects to the exhaust gas outlet.

Figure 5:
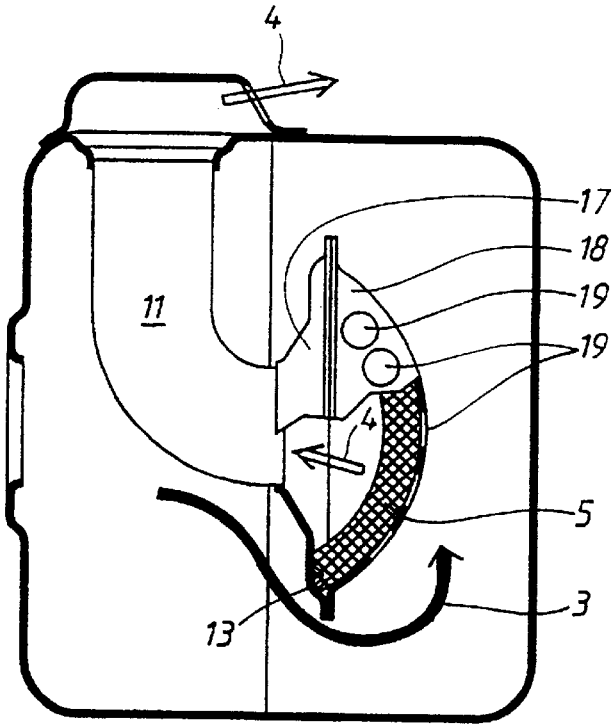
FIG. 5 shows a catalytic muffler provided with a bowl-shaped catalytic converter element.

FIG. 5 shows an embodiment where the catalytic converter element is composed of a bowl-shaped body 5. In the shown example it forms part of a sphere, but it could also be a semi-sphere or a similar kind of rotary-symmetric body. Consequently, in this case the body 5 has dome-shaped inner- and outer surfaces 6, 7. But it could also have angular surfaces, even if this is not as advantageous. The cover plate 18 is designed with a number of apertures 19, through which the exhaust gases 3 are flowing in order to continue in through the element. The body 5 is kept fixed in that its end surface 13 is resting against the mounting part 17 at the same time as the body is supported on the outer surface 7 of the cover plate 18 with the apertures 19. The mounting part 17 fastens the element onto the outlet pipe 11. In the same way as in the preceding embodiments the mounting part could be replaced by the partition wall 10. In the shown example no depression is made for the end surface into the mounting part 17. In this case the adjacent part of the cover plate will keep the end surface 13 fixed. If instead a semi-sphere should be used, it would be preferable to have an adapted depression in the mounting part 17, or in the partition wall when such a wall is used. The end surface 13 would then be kept fixed both on its inside as well on its outside. Owing to the bowl-shape of the body 5 a large through flow area is achieved. And at the same time the cover plate 18 will have a large area, which is advantageous, since the cover plate will be cooled down by the untreated exhaust gases 3. For, these have considerably lower temperature than the cleaned exhaust gases 4. Preferably the catalytic body 5 is produced in that round sheets are being crochetted. Depending on the thickness of the sheets one or several sheets are being calibration-pressed together, so that the desired bowl-shape is achieved. In the shown examples only one catalytic converter element is used. But several elements could be piled axially. Preferably adapted washers are then used to hold each end surface fixed.

What is claimed is:

1. A muffler with catalytic converter (1), in which at least one catalytic converter element (2) is located in the muffler, so that a substantial part of all exhaust gases (3) from the engine are forced to pass through the element (2) and be converted there into cleaned exhaust gases (4), characterized in that the element is a substantially self-supporting body made of catalytic material, which is hollow or partly concave and having inner and outer surfaces (6, 7) through which flow takes place, and the element is mounted onto a dividing part inside the muffler, and the mounting is arranged so that at least one end surface (13, 14) of the element is kept fixed, the outer surface (7) is supported by at least one part of the muffler and the inner surface (6) is substantially free.

2. A catalytic muffler (1) according to claim 1, characterized in that the inner and outer surfaces (6, 7) are curved in at least one direction.

3. A catalytic muffler (1) according to claim 1 or 2, further comprising:

a mounting part (17) that fastens the catalytic converter element (2) onto a pipe (11, 12); and a cover plate that is mounted to the mounting part or a partition wall and clamps the element between one of them and itself; and wherein the catalytic converter element (2) is a sleeve (8) having two end surfaces (13,14), the sleeve (8) being kept fixed in that both end surfaces (13,14) are protruding into adapted depressions (15,16), the depressions being respectively arranged in the mounting part (17) or the partition wall (10), and a cover plate (18).

4. A catalytic muffler (1) according to claim 3, characterized in that apertures (19) are arranged on the outside (20) of the cover plate (18), which supports the outer surface (7) of the element, and the mounting part (17), or the partition wall (10), are inside the adapted depression (15) connected to an outlet pipe (11), so that exhaust gases (3) hereby will flow radially inwards through the element (2).

5. A catalytic muffler (1) according to claim 3, characterized in that apertures (19) are arranged on the outside (20) of the cover plate (18), which supports the outer surface (7) of the element, and the mounting part (17), or the partition wall (10), are inside the adapted depression (15) connected to an inlet pipe (12), so that exhaust gases (3) hereby will flow radially outwards through the element (2).

6. A catalytic muffler (1) according to claim 3, characterized in that at least one inlet opening (21) is arranged inside the adapted depression in the cover plate (18) or the partition wall (10), and at least one outlet opening (22) is arranged outside the adapted depression in the partition wall or in the cover plate, so that exhaust gases (3) hereby will flow radially outwards through the element (2).

7. A catalytic muffler (1) according to claim 6, characterized in that the outlet opening (22) connects to the outlet pipe (11), which conducts the cleaned exhaust gases (4) out from the muffler.

8. A catalytic muffler (1) according to claim 2, characterized in that the sleeve has an axial length, which is smaller than its largest outer diameter.

9. A catalytic muffler (1) according to claim 1 or 2, characterized in that the catalytic converter element (2) is a bowl-shaped body (5), which is kept fixed in that its end surface (13) is resting against the partition wall (10) or a mounting part (17), and the body (5) is supported at the outer surface (7) of a cover plate (18) provided with apertures (19).

* * * * *